United States Patent [19]

Bartsch et al.

[11] Patent Number: 4,670,124

[45] Date of Patent: Jun. 2, 1987

[54] CATHODE FOR USE IN THE ELECTROLYTIC REFINING OF COPPER AND METHOD OF MAKING SAME

[75] Inventors: Adalbert Bartsch, Marxen; Joachim von Sawilski, Hamburg; Bernd Michalek, Seevetal, all of Fed. Rep. of Germany

[73] Assignee: Norddeutsche Affinerie Aktiengesellschaft, Hamburg, Fed. Rep. of Germany

[21] Appl. No.: 898,288

[22] Filed: Aug. 20, 1986

[30] Foreign Application Priority Data

Aug. 31, 1985 [DE] Fed. Rep. of Germany ..... 3531176

[51] Int. Cl.[4] ..... C25D 1/00

[52] U.S. Cl. ..... 204/281; 204/12; 204/106; 204/280; 204/286; 204/291

[58] Field of Search ..... 204/12, 281, 280, 106, 204/286, 291

[56] References Cited

U.S. PATENT DOCUMENTS

| | | | |
|---|---|---|---|
| 2,566,467 | 9/1951 | Symmes | 204/281 |
| 3,501,385 | 3/1970 | Jasberg | 204/12 |
| 3,798,151 | 3/1974 | Takamura et al. | 204/12 |
| 3,804,724 | 4/1974 | Bolger et al. | 204/12 |
| 3,830,710 | 8/1974 | Narozanski et al. | 204/12 |
| 4,137,130 | 1/1979 | Willans | 204/281 |
| 4,207,147 | 6/1980 | Babin | 204/281 |

FOREIGN PATENT DOCUMENTS

| | | | |
|---|---|---|---|
| 910844 | 9/1972 | Canada | 204/281 |
| 140624 | 3/1980 | German Democratic Rep. | 204/281 |
| 2040311 | 8/1980 | United Kingdom | 204/281 |
| 2104549 | 3/1983 | United Kingdom . | |

*Primary Examiner*—Arthur P. Demers
*Attorney, Agent, or Firm*—Karl F. Ross; Herbert Dubno

[57] ABSTRACT

A cathode for use in the electrolytic refining of copper which comprises a carrying bar and a flat starting plate, which is secured to the carrying bar and made of special steel and provided with electrically insulating edge strips at least at its vertical longitudinal edges, which are formed in their edge faces with a groove, which contains an edge strip, that is made of a natural or synthetic polymer and fits into said groove and protrudes from the edge throughout its length. To prevent a deposition of metal in the critical region, the insulating edge strip which has been fitted into the dovetail groove has been formed by a longitudinal folding of a polymer film and contains at its fold line a wire of special steel, and the side portions of said film are coextensive and lie one over the other and are liquid-tightly joined to each other. The invention relates also to a process of manufacturing the cathode.

16 Claims, 2 Drawing Figures

CATHODE FOR USE IN THE ELECTROLYTIC REFINING OF COPPER AND METHOD OF MAKING SAME

FIELD OF THE INVENTION

Our present invention relates to a permanent cathode for use in the electrolytic refining of copper, which cathode is immersed in a vertical orientation in an electrolyte and to a method of manufacturing the cathode.

BACKGROUND OF THE INVENTION

The cathodes used in the electrolytic refining of copper usually consist of starting plates of copper, which are connected to carrying bars having a length which exceeds the width of the cathode plate so that the carrying bars can be supported on the rim of the cell and an electric contact is made.

The starting plate as well as a pair of anode plates consisting of unrefined copper are immersed in a vertical orientation into the electrolyte of an electrolytic cell, or the starting plate is disposed between two insoluble anodes and together with the latter is immersed into the electrolyte of a cell for the electrowinning of metal.

Starting plates of copper must be manufactured by a special electrolytic process and cannot be reused because the copper deposited on them cannot be stripped off. In the prior art that disadvantage has been avoided by the provision of permanent cathodes consisting of starting plates made of titanium or a special steel, e.g. stainless steel.

Such a cathode made of stainless steel is particularly known from Open German application Ser. No. DE-OS 30 03 927 and is provided with a durable oxide layer, which facilitates and simplifies the removal of the copper that has been deposited on the plate whereas the oxide layer sufficiently retains the deposited copper layer as it is build up.

To permit a stripping of the copper in a simple operation, particularly by means of a machine, the copper deposit must not continuously embrace the edges of the cathode, particularly its vertical edges. It is known from Open German application Ser. No. DE-OS 30 03 927 that such difficulties can be avoided by providing at least those side edges of the starting plate which are at right angles to the carrying bar as a longitudinally grooved section bar, which is made of plastic and is held in position on the starting plate by means of plastic pins and additional adhesive joints. The plastic used in the known bar is a blend of polycarbonate and an acrylonitrile/butadiene/styrene (ABS) copolymer.

In the electrode for an electrolytic deposition of metals which is known from German Pat. No. 28 43 279 the corners of the metal plate are rounded and the insulation consists of a continuous insulating strip, which has been bent around the rounded corners. The material of the insulating strip has been forced by hot pressing into bores formed along the edges.

The cathode for an electrodeposition of metals which is known from French patent specification No. 2,388,062 is formed in its edge faces with a milled groove, in which an insulating strip made of a plastomer or elastomer has been fixed e.g., by press-forming. The outer portion of the insulating strip protrudes from the beadlike edge portions. For a deposition of, e.g., copper, the cathode may be made of stainless steel. As the beadlike portions for retaining the insulating strip are spaced different distances from the anode plate, the current density is locally increased and the deposition adjacent to the edges is undesirably increased. Besides, the assembly has an inadequate stability and involves high manufacturing costs.

The previously known arrangements comprising insulating materials, which usually consist of preshaped sections and are applied around the outer edges of the electrodes and are clamped and/or stuck thereto and in some cases are additionally fixed by mechanically means, such as rows of rivets, have the following disadvantages, inter alia:

The gap between the plate and the section member is open toward the ion stream.

The adhesive and the primer which initially fill the gap and are intended to ensure the bond between the metal plate and the plastic section fail after prolonged use owing to chemical, thermal and mechanical actions.

Owing to the differential thermal expansion of the plate material and the insulating material (plastic section), the cyclic temperature changes occurring during the periodic operation of the electrolytic cell give rise to deformation, to a formation of gaps and to shear fractures due to stresses, contraction and relaxation.

Owing to the growth of the deposited copper under the insulating section and into the gap which is open toward the ion stream, the cathode which has been formed is caught and can be stripped only with difficulty and a strong additional stress is imposed on the insulating material.

The irregular growth and the removal of defective electrodes involve a loss of operating time and a relatively high cost for repairs.

OBJECTS OF THE INVENTION

It is an object of the invention to provide for the electrodeposition of copper cathode in which the advantages of the known electrodes having insulating edge strips will be preserved but the known disadvantages, particularly those stated hereinbefore, will be avoided.

Another object is to provide an improved method of making the cathode.

SUMMARY OF THE INVENTION

These objects are accomplished in accordance with the invention in a cathode for use in the electrolytic refining of copper, which cathode comprises a carrying bar and a flat starting plate, which is secured to the carrying bar and made of special steel and provided with electrically insulating edge strips at least at its vertical longitudinal edges, which are formed in their edge faces with a groove, which contains an edge strip, that is made of a natural or synthetic polymer and fits into said groove and protrudes from the edge throughout its length.

According to the invention, the cathode is so designed that the insulating edge strip which has been fitted into the dovetail groove has been formed by a longitudinal folding of a polymer film and contains at its fold line a wire of special steel, and the side portions of said film are coextensive and lie one over the other and are liquid-tightly joined to each other.

The groove always have a flat or rounded bottom. The side walls of the groove are chamfered on the outside and have been pressed to define a dovetail section, which at its constricted opening has a width that is approximately as large as twice the thickness of the plastic film. The side walls of the groove, which have been shaped to define a dovetail groove, and the insulating edge strip in the groove interfit in the critical region to form a positive, liquid-tight joint. Owing to the liquid-tight joint between the side portions of the film, an ingress of electrolyte and a deposition of crystals between said side portions will be prevented.

The liquid-tight joint may consist of an adhesive joint or a welded joint. The nature of the joint will depend on the material of which the edge strip is made.

The edge strip is made of an electrically insulating material consisting of natural or synthetic polymers, such as natural or synthetic rubber, e.g., butadiene homopolymers, copolymers or block copolymers of butadiene with unstaturated monomers, such as styrene or acrylonitrile; or of halogen-containing rubbers, such as polychloroprene; or of thermoplastic polymers, such as polyolefins, polycarbonte; or of halogen-containing polymers, such as polymers or copolymers of vinyl chloride or vinylidene chloride; or of polytetrafluoroethylene or polyurethanes.

Weldable materials which are particularly preferred for the polymer strip comprise thermoplastic elastomers, such as block copolymers of butadiene with styrene, or thermoplastic polymers, e.g. halogen-containing vinyl polymers. It is desirable to use a polyvinylchloride material, which can easily be welded.

The starting material used to make the edge strip for a cathode in accordance with the invention suitably consists of PVC film having a width of about 30 to 35 mm and a thickness of about 0.4 to 0.6 mm. To form a pocketlike wrapper, the polymer film is longitudinally folded at its center, possibly in a continuous operation, and preferably about a metal wire which is about 0.8 to 1.2 mm in diameter and may consist, e.g of an erosion-resulting, e.g. stainless steel.

For that purpose the film and the wire are withdrawn from supply drums and brought together by suitable means, and the film is subsequently folded by suitable means alternatively, the wire may subsequently be introduced at the fold line into the film when it has been folded or has been folded and welded.

The folded strip provided with the wire at the fold line is suitably supplied to a welding device. The coextensive side portions of the film are joined by a welded linear or surface joint, as may be required.

A welded linear joint will preferably be formed as a welded edge joint which is parallel and at right angles to the fold line; in that case the welded joint extending at right angles to the fold line extends close to that fold line.

A welded surface joint is also terminated close to the fold line. In general it will be sufficient, however, to provide a welded surface joint between the side portions of the strip only in those areas in which the side portions laterally protrude from the side wall of the groove.

Any gap left between the inserted wire and the fold line will be closed by an injection of a highly fluid synthetic resin, which is curable to form an elastomer, e.g. by an injection of a silicone resin which sets in the presence of moisture.

In general, a groove in the edge faces is formed only at the longitudinal edges, which extend at right angles to the carrying bar. But a groove for receiving an insulating edge strip may be formed also in the bottom edge. The groove has usually a depth of 4.5 to 6 mm, preferably of 5.5 mm. Owing to the small depth of the groove there is a favorable ratio of side wall thickness to side wall width so that the assembly has a higher stability.

The insulating edge strip generally protrudes from the edge by 5 to 20 mm, suitably by 8 to 15 mm. An overhang of 10 mm will be sufficient in many cases.

It is also desirable to deburr the edges of the cathode plate or of the side walls of the groove on the inside where they contact the insulating strip so that the insulating strip will not be damaged as it is inserted into the groove. The side walls of the groove are chamfered on the outside toward the edge strip at a positive angle relative to the deposit on the cathode. That design will prevent a catching of the deposited cathode as it is stripped off.

The cathode is suitably made of stainless steel, e.g. a special steel which contains about 18% chromium, about 10% nickel, about 2% molybdenum and less than 0.1% carbon. Such steels form a strong bond to the deposited copper during its deposition but permit the deposit to be stripped easily an in automatic operation. Whereas the carrying bar of the cathode in accordance with the invention may be made of the same material as the cathode, that part of the carrying bar which is used to supply current suitably consists of copper.

The invention relates also to a method of manufacturing an edge-insulated cathode for use in the electrolytic refining of copper, comprising a carrying bar and a flat starting plate, which is secured to the carrying bar and is made of special steel and at least at its vertical longitudinal edges is provided with electrically insulating edge strips, wherein the edge faces at the longitudinal edges are formed with a groove, which contains an edge strip, which is made of a natural or synthetic polymer and fits the groove and protrudes from the edge throughout its length. The process in accordance with the invention resides in that:

(a) grooves having preferably a curved bottom are cut into the edge faces of the starting plate;

(b) the side walls of the grooves are deformed by non-cutting shaping to form a dovetail groove;

(c) an insulating edge strip containing a wire of special steel is inserted into one end of the tapered groove thus formed and is pulled into the groove in its longitudinal direction and in such a manner that the edge strip protrudes beyond the side walls of the groove, which tapers to a width that is not in excess of the thickness of the edge strip; and (d) the wire of special steel is introduced into a centrally folded polymer film to extend at the fold line there of and the coextensive side portions of the film are liquid-tightly joined.

The pulling of the edge strip made of the folded and welded film and containing the inserted wire into the groove is preferably begun at the lower end of the grooved edge and may be assisted by the use of a lubricant. The edge strip is then pulled beyond the upper horizontal remains, which will facilitate the subsequent replacement of the edge strip when it has been used. For such replacement, the wire is pulled out first and the film material is subsequently removed from the groove. By the pulling operation and the frictional resistance involved therein, the edge strip is elongated and its cross-section is reduced so that strip will contract and will liquid-tightly close the narrow groove when the tensile forces are no longer inserted.

A number of advantages are afforded by the invention. In comparison with cathodes having convention edge-insulating means, the effective width of the cathode in a cell having a given dimension is increased. A warping of materials caused by differential coefficients of expansion of the different materials of the cathode and the insulating strip are avoided. The inserted metal wire prevents a lateral wandering or longitudinal pulling of the edge strip from the tapered groove during operation. For a renewal, the wire can easily be pulled out in the longitudinal direction and the insulating strip can then be removed. The service life of the electrode is increased so that downtimes and repair costs are reduced.

BRIEF DESCRIPTION OF THE DRAWING

The above and other objects, features and advantages of the invention will become more readily apparent from the following description, reference being made to the accompanying drawing in which.

SPECIFIC DESCRIPTION

Figure 1:
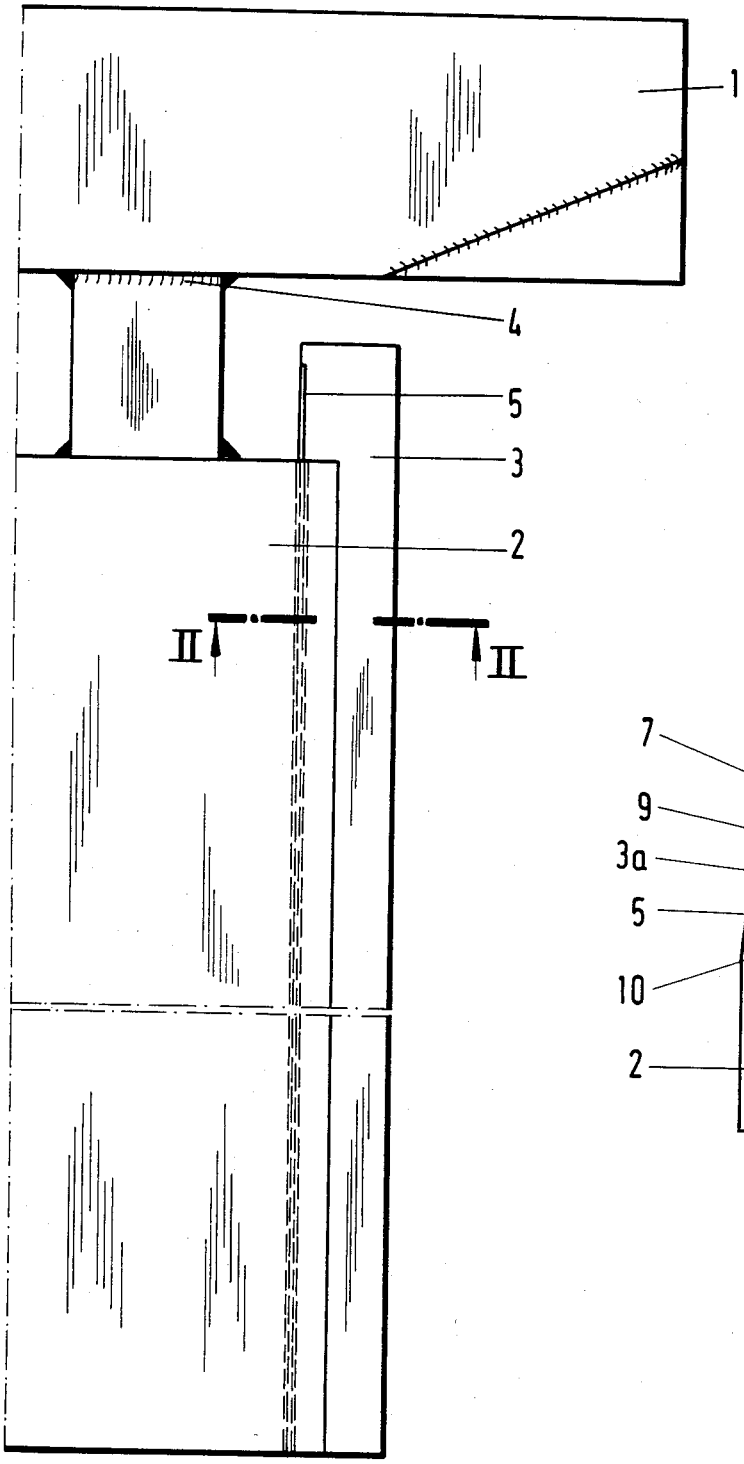
FIG. 1 is a side elevation showing the cathode provided with an insulating edge strip in accordance with the invention.

In accordance with FIG. 1, the cathode 2 is welded at lugs 4 to the carrying bar 1. An insulating edge strip 3 containing an inserted wire 5 has been fitted into a groove, which has been milled into the edge face of a side edge or longitudinal edge which is at right angles to the carrying bar.

Figure 2:
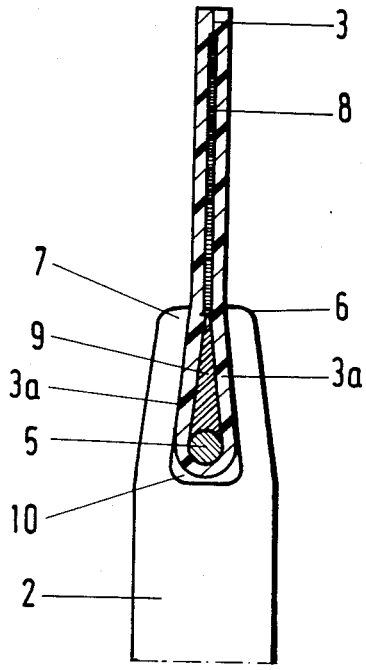
FIG. 2 is an enlarged sectional view taken on line II—II of FIG. 1.

FIG. 2 is a sectional view that is taken on line II—II of FIG. 1. The, edge strip 3 comprises portions 3*a*, which positively fit between the side walls 7 at the edge of the cathode 2. The side walls 7 have edges 6, which are deburred on the inside. The side walls 7 are chamfered on the outside toward the edge strip at a positive angle to the deposit to be formed on the cathode. The gap 9 which contains the inserted wire 5 has been filled with an elastomer. A welded surface joint is designated 8. A portion of the original milled groove is designated 10. Under a sufficiently high pressure, that groove is completely and liquid-tightly filled by the deformable film material in which the elastomeric resin and the wire are enclosed.

We claim:

1. A cathode for use in the electrolytic refining of copper, comprising:

a carrying bar;

a cathode plate composed of an eroding-resistant steel secured to but depending from said bar, said cathode plate being formed along its longitudinal vertical edges each with a laterally open groove of dovetail cross section over the entire length of the edge; and a respective insulating edge strip received in each groove and projecting laterally from the respective edge throughout its length, each of said edge strips being formed of a folded strip of a polymeric foil whose fold is received in the respective groove, and a wire of an eroding-resistant steel received in each fold, each said folded strip having side portions extending away from the fold and out of said groove, said side portions outwardly of said edge being coextensive with one another, lying against one another and being bonded together in a liquid-tight joint.

2. The cathode for use in the electrolytic refining of copper defined in claim 1 wherein said liquid-tight joint is an adhesive joint.

3. The cathode for use in the electrolytic refining of copper defined in claim 1 wherein said liquid-tight joint is a weld joint.

4. The cathode for use in the electrolytic refining of copper defined in claim 3 wherein said weld joint is formed by a linear weld seam.

5. The cathode for use in the electrolytic refining of copper defined in claim 4 wherein said linear weld seam is formed as an edge seam around the peripheries of said side portions.

6. The cathode for use in the electrolytic refining of copper defined in claim 3 wherein said weld joint is formed by a surface weld bonding between said side portions.

7. The cathode for use in the electrolytic refining of copper defined in claim 1 wherein at least one gap is formed between said strip and said wire, further comprising a filling of cured liquid resin in said gap.

8. The cathode for use in the electrolytic refining of copper defined in claim 1 wherein said edge strips extend above the upper edge of said cathode plate.

9. The cathode for use in the electrolytic refining of copper defined in claim 1 wherein said dovetail grooves are formed at least in part by deforming edge regions of said cathode plate and sidewalls of each groove engage the respective edge strip so as to form a positive liquid-tight joint therewith.

10. In a method of making a cathode for use in the electrolytic refining of copper wherein a cathode plate is attached to a carrying bar so as to depend therefrom, the improvement which comprises the steps of:

cutting grooves into the longitudinal vertical edges of said plate to define a bottom of each groove and a pair of flanks reaching from said bottom to a laterally open mouth of each groove;

deforming edge portion of the plate to press the flanks of each groove toward one another and impart a dovetail cross section to each groove;

inserting a fold of a polymer foil into each groove from one end thereof after having introduced a wire of eroding-resistant steel in each fold and having bonded the side portions of each edge strip together in a liquid-tight joint and drawing the fold longitudinally along the respective groove, side portions of the foil projecting outwardly beyond the respective edge of the cathode plate at which the flanks of the respective groove taper to a width of said mouth not in excess of the thickness of the edge strip formed by the foil.

11. The method defined in claim 10 wherein said liquid-tight joint is formed as an adhesive joint.

12. The method defined in claim 10 wherein said liquid-tight joint is formed as a weld joint.

13. The method defined in claim 12 wherein said weld joint is formed by a linear weld seam.

14. The method defined in claim 13 wherein said linear weld seam is formed as an edge seam around the peripheries of said side portions.

15. The method defined in claim 12 wherein said weld joint is formed by a surface weld bonding between said side portions.

16. The method defined in claim 10 wherein at least one gap is formed between said strip and said wire, further comprising filling said gap with curable liquid resin.

* * * * *